US010082120B2

(12) United States Patent
Kitano et al.

(10) Patent No.: US 10,082,120 B2
(45) Date of Patent: Sep. 25, 2018

(54) ENGINE AUTOMATIC STOP AND START DEVICE, AND ENGINE AUTOMATIC STOP AND START CONTROL METHOD

(75) Inventors: Hiroaki Kitano, Chiyoda-ku (JP); Daisuke Mizuno, Chiyoda-ku (JP); Koichiro Kamei, Chiyoda-ku (JP); Kazuhiro Odahara, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 1122 days.

(21) Appl. No.: 13/990,504

(22) PCT Filed: Jan. 24, 2012

(86) PCT No.: PCT/JP2012/051410

§ 371 (c)(1),
(2), (4) Date: May 30, 2013

(87) PCT Pub. No.: WO2012/114809

PCT Pub. Date: Aug. 30, 2012

(65) Prior Publication Data

US 2013/0255614 A1 Oct. 3, 2013

(30) Foreign Application Priority Data

Feb. 24, 2011 (JP) ..... 2011-038015

(51) Int. Cl.
*F02N 11/08* (2006.01)
*F02D 29/02* (2006.01)

(52) U.S. Cl.
CPC ..... *F02N 11/0803* (2013.01); *F02D 29/02* (2013.01); *F02N 11/0855* (2013.01); *F02N 11/0844* (2013.01); *F02N 11/0851* (2013.01)

(58) Field of Classification Search
CPC ... F02N 11/0803; F02N 11/0855; F02D 29/02
See application file for complete search history.

(56) References Cited

U.S. PATENT DOCUMENTS 8,290,692 B2 10/2012 Kitano et al.
2008/0127927 A1* 6/2008 Hirning et al. ..... 123/179.3

FOREIGN PATENT DOCUMENTS

CN 101886599 A 11/2010
JP 2002-048037 A 2/2002
(Continued)

OTHER PUBLICATIONS

Japanese Office Action (Preliminary Notice of Reasons for Rejection), dated Dec. 10, 2013, Patent Application No. 2013-500926.
(Continued)

*Primary Examiner* — Jacob Amick
(74) *Attorney, Agent, or Firm* — Sughrue Mion, PLLC; Richard C. Turner

(57) ABSTRACT

Provided is a device for automatically stopping an engine when an automatic stop condition is satisfied and restarting the engine thereafter when a restart condition is satisfied, the device including: a ring gear (12) to be coupled to a crankshaft of the engine; a starter motor (14) for starting the engine; a pinion gear (16) for transmitting rotation of the starter motor to the ring gear; pinion-gear moving means (17) for moving the pinion gear by energization to bring the pinion gear into meshing engagement with the ring gear; and starter control means (11) for controlling a voltage to be applied to the pinion-gear moving means so as to fall within a predetermined range when the pinion gear and the ring gear are brought into meshing engagement by moving the pinion gear by the pinion-gear moving means.

9 Claims, 7 Drawing Sheets

(56) References Cited

FOREIGN PATENT DOCUMENTS

| | | | |
|---|---|---|---|
| JP | 2002-339846 | A | 11/2002 |
| JP | 2004-308645 | A | 11/2004 |
| JP | 2005-330813 | A | 12/2005 |
| JP | 2008-510099 | A | 4/2008 |
| JP | 2009-068426 | A | 4/2009 |
| JP | 2009-287459 | A | 12/2009 |
| JP | 2010-229882 | A | 10/2010 |
| JP | 2011-231690 | A | 11/2011 |
| WO | 2006/018350 | A2 | 2/2006 |

OTHER PUBLICATIONS

Communication dated Apr. 3, 2015 from the State Intellectual Property Office of the P.R.C. in counterpart application No. 201280007844.8.

* cited by examiner

ENGINE AUTOMATIC STOP AND START DEVICE, AND ENGINE AUTOMATIC STOP AND START CONTROL METHOD

CROSS REFERENCE TO RELATED APPLICATIONS

This application is a National Stage of International Application No. PCT/JP2012/051410 filed Jan. 24, 2011, claiming priority based on Japanese Patent Application No. 2011-038015, filed Feb. 24 2011, the contents of all of which are incorporated herein by reference in the entirety.

TECHNICAL FIELD

The present invention relates to an engine automatic stop and start device and an engine automatic stop and start control method for an automatic idling-stop system for automatically stopping an engine based on satisfaction of a predetermined automatic stop condition and for then restarting the engine based on satisfaction of a restart condition.

BACKGROUND ART

Conventionally, automatic idling-stop systems, which automatically stop idling when a predetermined condition is satisfied, have been developed for the purposes of improvement of fuel efficiency of an automobile, reduction of an environmental load, and the like. Among the automatic idling-stop systems, the one using a starter requires only a small change in a system of a vehicle, and therefore is low in cost. On the other hand, however, there is a problem in that meshing engagement cannot be achieved until the engine is completely stopped.

In order to cope with the problem described above, there exists an idling-stop system which rotates a starter motor during cut-off of a fuel to an engine and then controls energization of the starter motor to rotate the starter motor by inertia so as to connect the starter motor to the engine while both the engine and the starter motor are rotating by inertia (see Patent Literature 1, for example).

Moreover, there also exists an engine automatic stop and restart device, which predicts a future ring-gear rpm to predict time at which a pinion rpm comes into synchronization with the future ring-gear rpm and controls pinion-gear pushing timing or pushing speed so that the pinion rpm and the ring gear rpm come into synchronization at the predicted time (see Patent Literature 2, for example).

CITATION LIST

Patent Literature

[PTL 1] JP 2010-229882 A
[PTL 2] JP 2005-330813 A

SUMMARY OF INVENTION

Technical Problem

However, the related art has the following problems.

Patent Literature 1 does not mention a restart request for restarting the engine at all. Therefore, even when the engine is not required to be restarted, the starter motor is rotated to be connected to the engine in some cases, which may lead to consumption of electric power, component wear, or the like.

In Patent Literature 2, the future ring-gear rpm is predicted to predict the time at which the pinion rpm and the ring-gear rpm come into synchronization, and the pushing speed or the pushing timing is controlled so that the pinion rpm and the ring-gear rpm come into synchronization at the predicted time. Therefore, when the pushing speed is to be controlled, sensors and control means for controlling the speed are required, which may lead to increase in cost.

Moreover, even when only the pushing timing is to be controlled, a battery voltage is lowered and a voltage to a solenoid for pushing the pinion is also lowered because of the energization of the starter motor. Therefore, time required for the pinion to reach the ring gear becomes longer than estimated time, which may result in a difference in rpm between the pinion gear and the ring gear. As a result, there is a fear of generation of noise or component wear.

The present invention has been made to solve the problems described above, and therefore has an object to provide an engine automatic stop and start device and an engine automatic stop and start control method, which enable meshing engagement between a pinion gear and a ring gear to be achieved quickly and quietly while an engine is rotating by inertia in an automatic idling-stop system, without requiring a large computation load and an increase in cost.

Solution to Problem

According to the present invention, there is provided an engine automatic stop and start device for an automatic idling-stop system for automatically stopping an engine when an automatic stop condition is satisfied and restarting the engine thereafter when a restart condition is satisfied, the engine automatic stop and start device including: a ring gear to be coupled to a crankshaft of the engine; a starter motor for starting the engine; a pinion gear for transmitting rotation of the starter motor to the ring gear; pinion-gear moving means for moving the pinion gear by energization to bring the pinion gear into meshing engagement with the ring gear; and starter control means for controlling a voltage to be applied to the pinion-gear moving means so as to fall within a predetermined range when the pinion gear and the ring gear are brought into meshing engagement by moving the pinion gear by the pinion-gear moving means.

Further, according to the present invention, there is provided an engine automatic stop and start control method used for an engine automatic stop and start control device for an automatic idling-stop system for automatically stopping an engine when an automatic stop condition is satisfied and restarting the engine thereafter when a restart condition is satisfied, the engine automatic stop and start control device including: a ring gear to be coupled to a crankshaft of the engine; a starter motor for starting the engine; a pinion gear for transmitting rotation of the starter motor to the ring gear; and pinion-gear moving means for moving the pinion gear by energization to bring the pinion gear into meshing engagement with the ring gear, the engine automatic stop and start control method including: a meshing-engagement control step of bringing the pinion gear into meshing engagement with the ring gear by energizing the starter motor to rotate the pinion gear and moving the pinion gear by the pinion-gear moving means when the restart condition is satisfied during inertial rotation of the engine based on the satisfaction of the automatic stop condition, in which the meshing-engagement control step includes controlling a voltage to be applied to the pinion-gear moving means so as to fall within a predetermined range by suppressing a current flowing through the starter motor at least before the pinion gear comes into contact with the ring gear.

Advantageous Effects of Invention

According to the engine automatic stop and start device and the engine automatic stop and start control method of the present invention, the voltage to be applied to the pinion-gear moving means is controlled so as to fall within the predetermined range when the pinion gear and the ring gear are to be brought into meshing engagement by moving the pinion gear by the pinion-gear moving means. As a result, there can be provided the engine automatic stop and start device and the engine automatic stop and start control method, which enable the meshing engagement between the pinion gear and the ring gear to be achieved quickly and quietly while the engine is rotating by inertia in the automatic idling-stop system without requiring a large computation load and an increase in cost.

DESCRIPTION OF EMBODIMENTS

Figure 1:
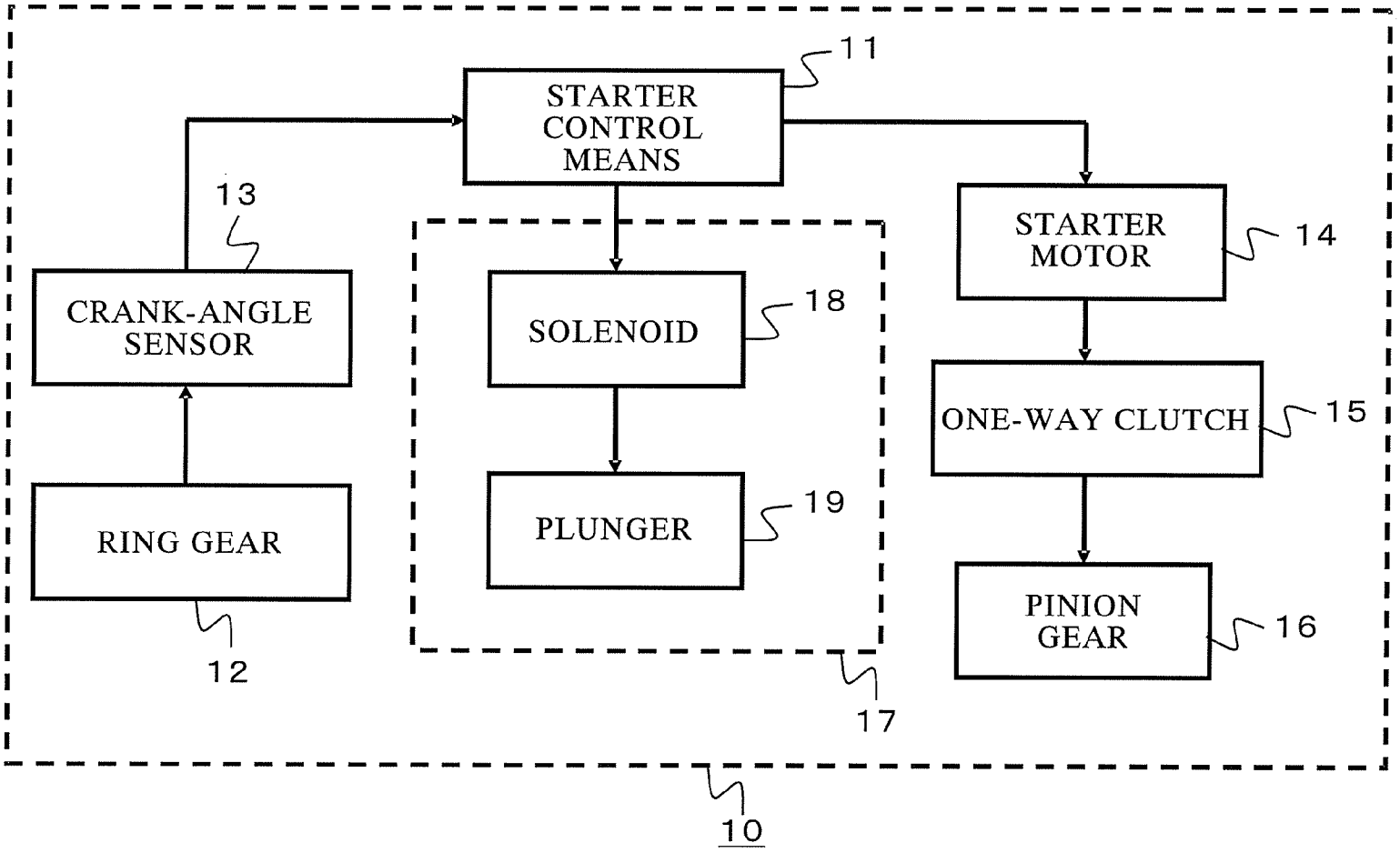
FIG. 1 A block diagram illustrating a schematic configuration of an engine automatic stop and start device according to a first embodiment of the present invention.

In the following, an engine automatic stop and start device and an engine automatic stop and start control method according to the present invention are described referring to the drawings by way of embodiments.

First Embodiment

FIG. 1 is a block diagram illustrating a schematic configuration of an engine automatic stop and start device according to a first embodiment of the present invention. An engine automatic stop and start device 10 of the first embodiment illustrated in FIG. 1 includes starter control means 11, a ring gear 12, a crank-angle sensor 13, a starter motor 14, a one-way clutch 15, a pinion gear 16, and pinion-gear moving means 17. Further, the pinion-gear moving means 17 includes a solenoid 18 and a plunger 19.

The starter control means 11 controls energization of the starter motor 14 and the solenoid 18. The ring gear 12 comes into meshing engagement with the pinion gear 16 to transmit a driving force to an engine. The crank-angle sensor 13 detects a crank angle of the engine. The starter motor 14 rotates the pinion gear 16 by energization.

The one-way clutch 15 is coupled to an output shaft of the starter motor 14, and spins when torque is input from the ring gear 12. Further, the pinion-gear moving means 17 attracts the plunger 19 to move the pinion gear 16 through an intermediation of a lever (not shown) by the energization of the solenoid 18, thereby bringing the pinion gear 16 into meshing engagement with the ring gear 12.

The starter control means 11 can calculate an engine rpm from a cycle of a rotation pulse of a crankshaft, which is output from the crank-angle sensor 13. A relay may be provided between the starter control means 11 and any one of the solenoid 18 and the starter motor 14 so that the relay is driven by a command of the starter control means 11 to control the energization.

Description is now given of an engine inertial-rotation behavior in the engine automatic stop and start device according to the first embodiment, which has the configuration illustrated in FIG. 1, when automatic stop conditions are satisfied.

When automatic stop conditions (for example, a vehicle speed of 15 km/h or lower, the depression of a brake pedal by a driver, and the like) are satisfied while the vehicle is running, fuel supply to the engine is stopped to rotate the engine by inertia.

Figure 2:
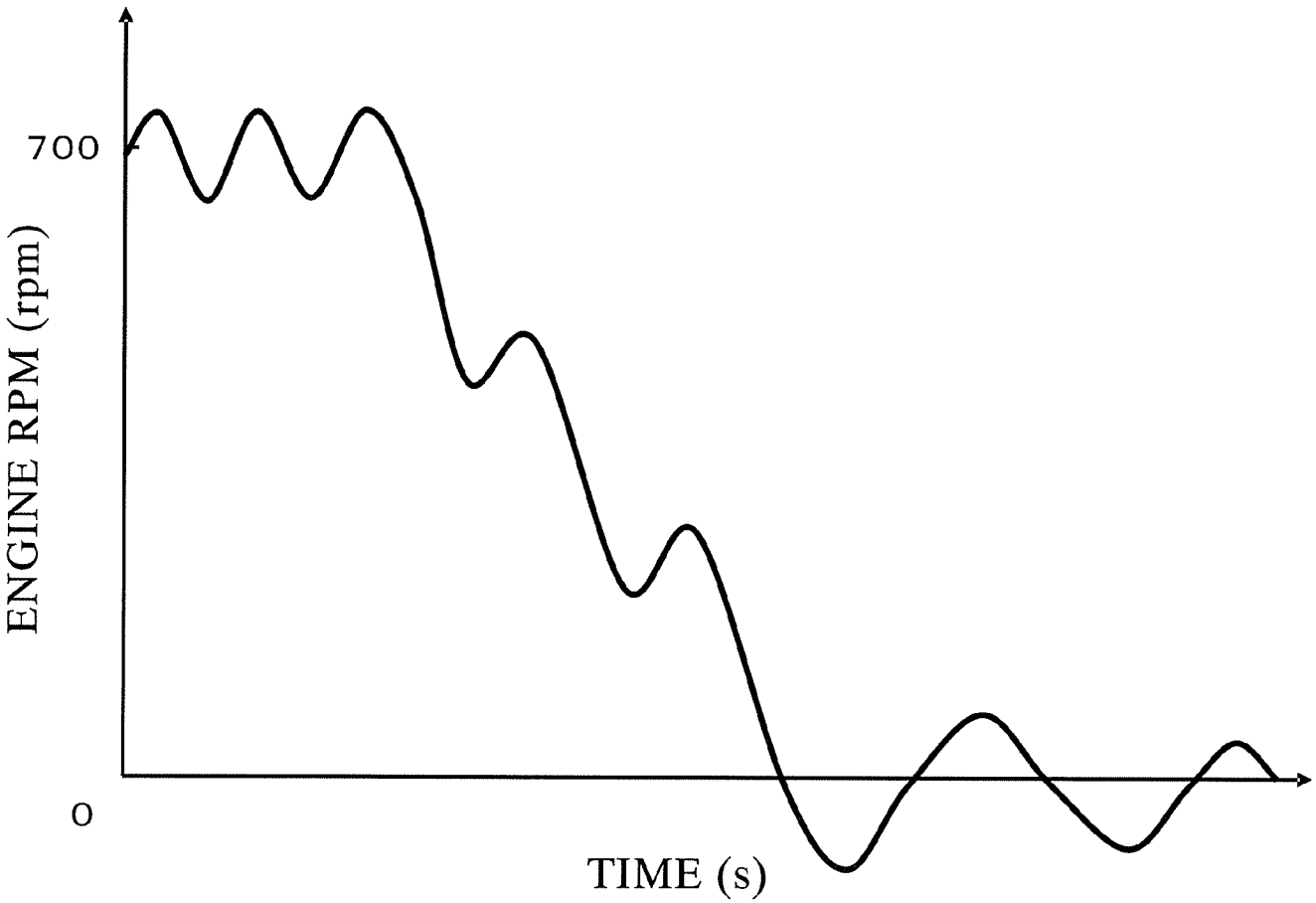
FIG. 2 A conceptual diagram showing an engine stop characteristic according to the first embodiment of the present invention.

FIG. 2 is a conceptual diagram showing an engine stop characteristic according to the first embodiment of the present invention. As a result of the satisfaction of the automatic stop conditions, the starter control means 11 stops the fuel supply to the engine to rotate the engine by inertia. As a result, as shown in FIG. 2, a torque fluctuation is generated by compression and expansion cycles of an engine piston, and hence the engine rpm decreases with pulsations.

Then, when the rpm becomes equal to zero, the engine starts rotating in a reverse direction by a reaction force of the piston during a compression stroke. Thereafter, the engine continues rotating for a while. Then, now by a reaction force of the piston in an expansion stroke, the engine starts rotating in a forward direction. The forward rotation and the reverse rotation are repeated in the above-mentioned manner. Finally, when a rotational friction of the engine becomes greater than the reaction force of the piston, the engine completely stops.

Figure 3:
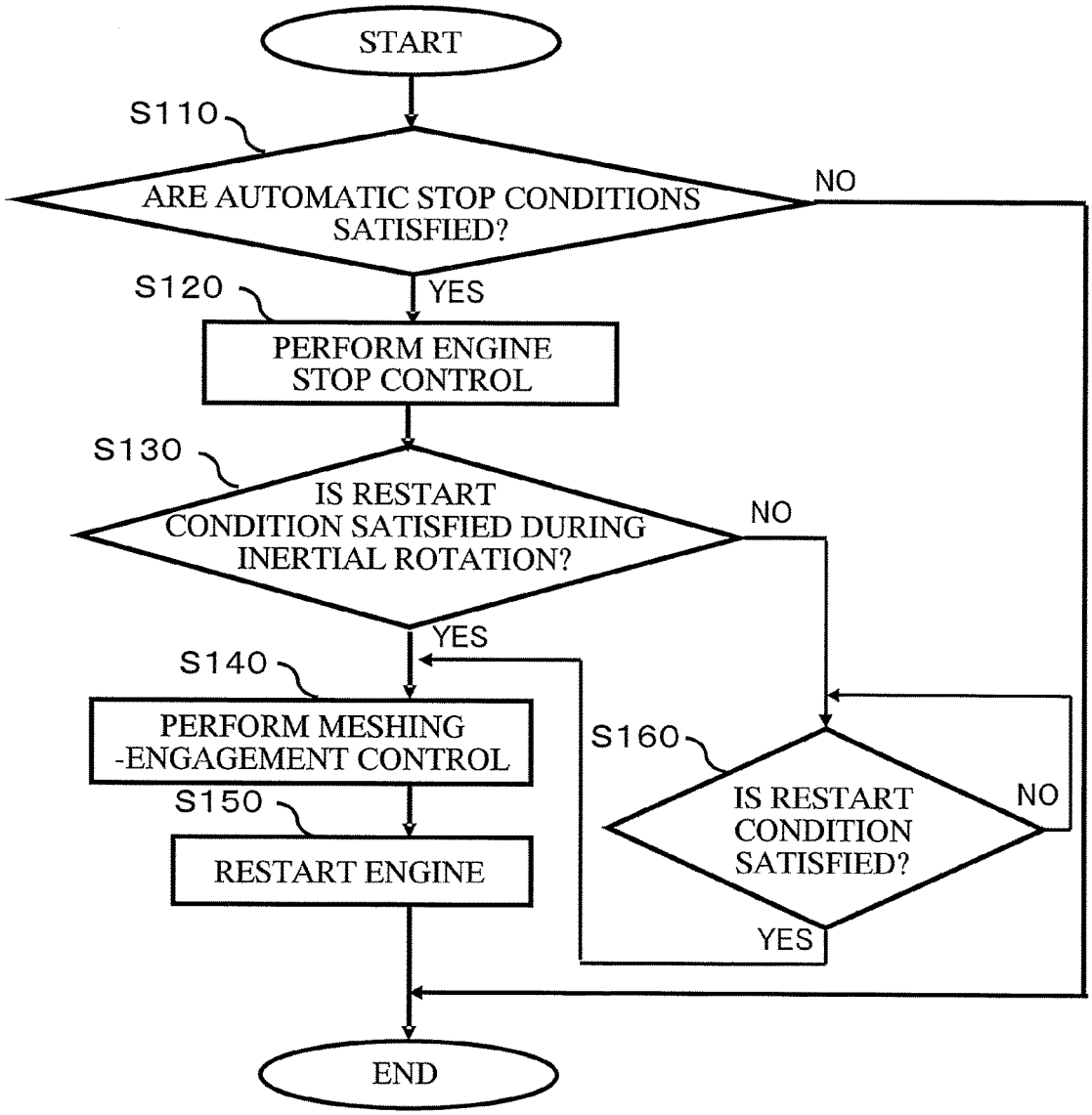
FIG. 3 A flowchart illustrating a flow of engine automatic stop and automatic start according to the first embodiment of the present invention.
Figure 4:
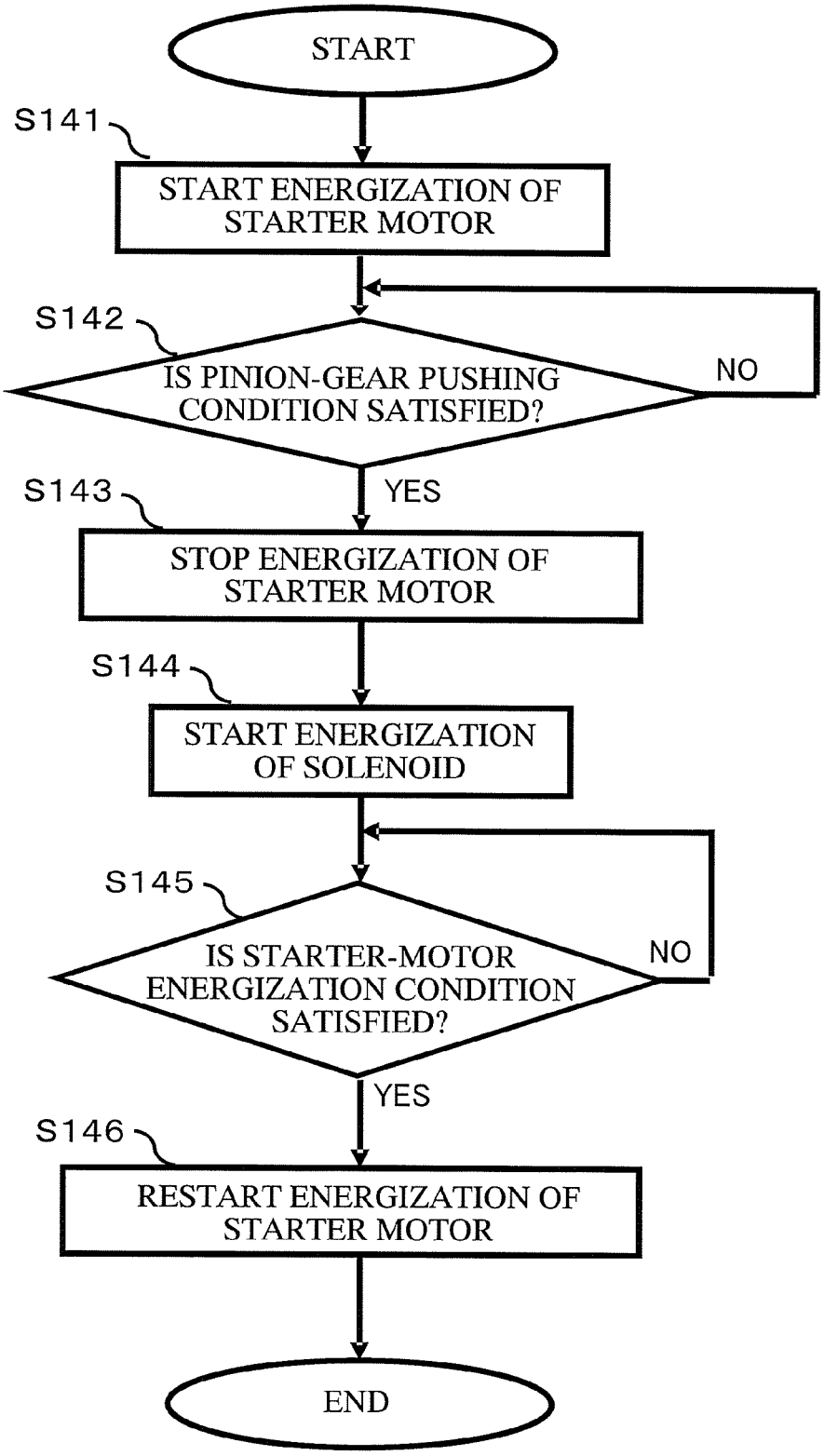
FIG. 4 A flowchart illustrating a flow of meshing-engagement control after an engine is automatically stopped according to the first embodiment of the present invention.

Next, a specific operation of the engine automatic stop and start device according to the first embodiment is described in detail referring to FIGS. 3 and 4.

FIG. 3 is a flowchart illustrating a flow of engine automatic stop and automatic start according to the first embodiment of the present invention. First, in Step S110, the starter control means 11 determines whether or not the automatic stop conditions are satisfied. When it is determined in Step S110 that the automatic stop conditions are not satisfied, the starter control means 11 terminates a processing series, and the processing proceeds to the next control cycle.

On the other hand, when it is determined in Step S110 that the automatic stop conditions are satisfied, the processing proceeds to Step S120 where the starter control means 11 performs engine stop control. Specifically, the starter control means 11 stops the fuel supply to the engine to lower the rpm by the inertial rotation. In order to suppress vibrations during the inertial rotation, the starter control means 11 may perform air-intake control.

Next, in Step S130, the starter control means 11 determines whether or not a restart condition is satisfied during the inertial rotation of the engine. When the starter control means 11 determines that the restart condition is satisfied, the processing proceeds to Step S140.

Then, in Step S140, the starter control means 11 starts meshing-engagement control so that the ring gear 12 and the pinion gear 16 are brought into meshing engagement. The details of the operation in Step S140 are described later referring to FIG. 4.

Thereafter, in Step S150, the starter control means 11 restarts the engine.

When the starter control means 11 determines in Step S130 described above that the restart condition is not satisfied during the inertial rotation of the engine (or while the rpm is lowered to a level which allows the pinion gear 16 and the ring gear 12 to be brought into meshing engagement without rotating the starter motor 14), the processing proceeds to Step S160.

Then, in Step S160, the starter control means 11 determines whether or not the restart condition is satisfied. When it is determined that the restart condition is satisfied, the pinion gear 16 is brought into meshing engagement with the ring gear 12 (corresponding to Step S140) to restart the engine (corresponding to Step S150).

Next, the details of a meshing-engagement control operation in Step S140 illustrated in FIG. 3 referred to above are described referring to FIG. 4. FIG. 4 is a flowchart illustrating a flow of the meshing-engagement control after the engine is automatically stopped according to the first embodiment of the present invention.

In Step S130 illustrated in FIG. 3 referred to above, when the starter control means 11 determines that the restart condition is satisfied during the inertial rotation of the engine, the meshing-engagement control is performed by a processing series performed in Steps S141 to S146 illustrated in FIG. 4.

First, in Step S141, the starter control means 11 starts the energization of the starter motor 14. Thereafter, in Step S142, the starter control means 11 determines whether or not a pinion-gear pushing condition (for example, elapse of predetermined time, a difference in rpm between the pinion gear 16 and the ring gear 12 equal to or smaller than a predetermined rpm difference, or the like) is satisfied.

When the starter control means 11 determines in Step S142 that the pinion pushing condition is satisfied, the processing proceeds to Step S143 where the energization of the starter motor 14 is temporarily stopped. Simultaneously, in Step S144, the starter control means 11 starts energizing the solenoid 18 to move the pinion gear 16 so that the pinion gear 16 is brought into meshing engagement.

Next, in Step S145, the starter control means 11 determines whether or not a starter-motor energization condition is satisfied. Here, the starter-motor energization condition signifies, for example, elapse of predetermined time required for the pinion gear 16 to come into meshing engagement with the ring gear 12. In this case, the starter control means 11 can determine the satisfaction of the starter-motor energization condition based on the elapse of the predetermined time.

When the starter-motor energization condition is satisfied in Step S145, the processing proceeds to Step S146 where the starter control means 11 restarts energizing the starter motor 14 (Step S146) to restart the engine by cranking.

Figure 5:
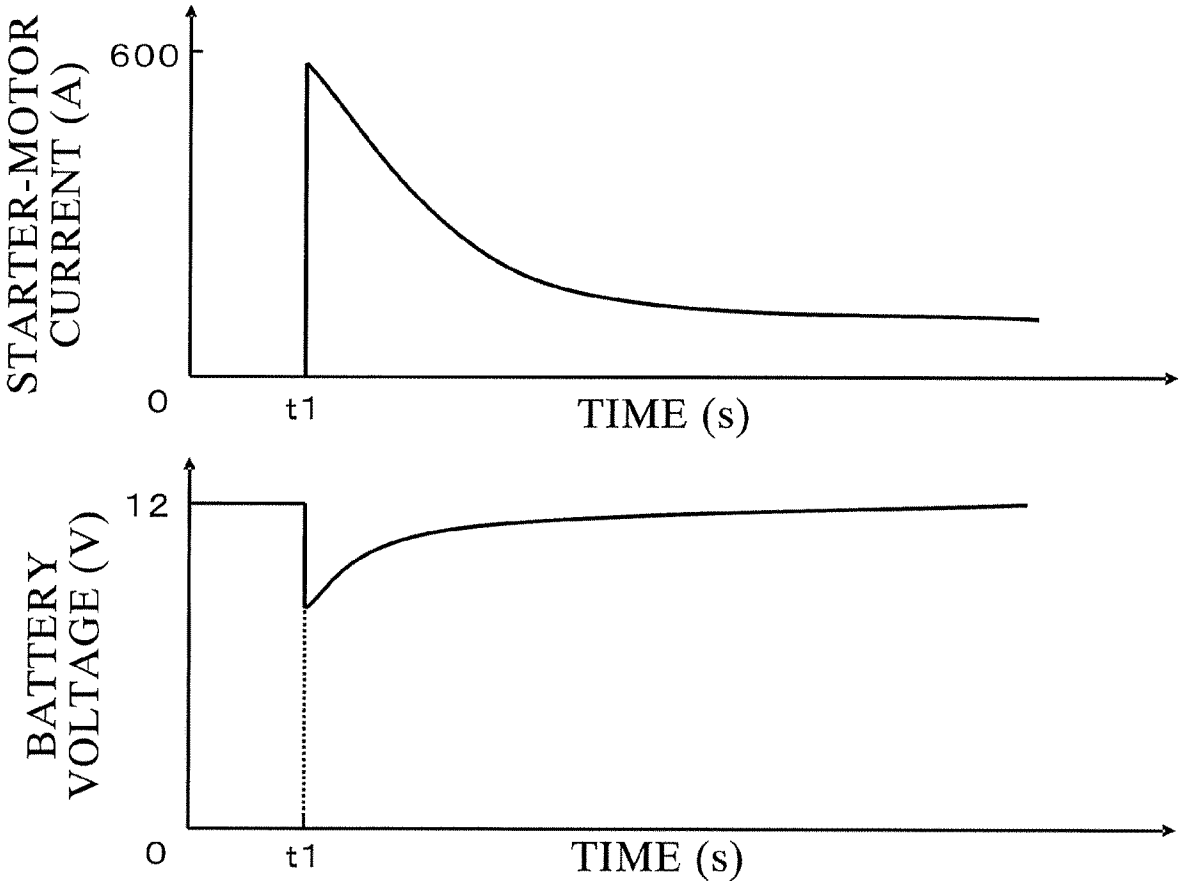
FIG. 5 A conceptual diagram showing the relationship between a current flowing through a starter motor and a power-supply voltage according to the first embodiment of the present invention.

FIG. 5 is a conceptual diagram showing the relationship between a current flowing through the starter motor 14 and a power-supply voltage according to the first embodiment of the present invention. Specifically, a starter-motor current and a battery voltage in the case where the starter motor 14 is energized by a 12V-battery are shown.

In general, as shown in FIG. 5, when the energization of the starter motor 14 is started at time t1, an inrush current at about 400 to 600 A is generated. With the generation of the inrush current, a voltage applied to the solenoid 18 is lowered by an internal resistance of the battery, a wiring resistance, or the like. Moreover, as the rpm of the starter motor 14 becomes higher, a back electromotive force becomes greater to result in the reduced current. As a result, the battery voltage is recovered.

However, when the solenoid 18 is energized during the decrease in the battery voltage due to the inrush current so as to bring the pinion gear 16 into meshing engagement with the ring gear 12, the voltage applied to the solenoid 18 becomes low. Therefore, a desired operation characteristic cannot be obtained in some cases.

Figure 6A:
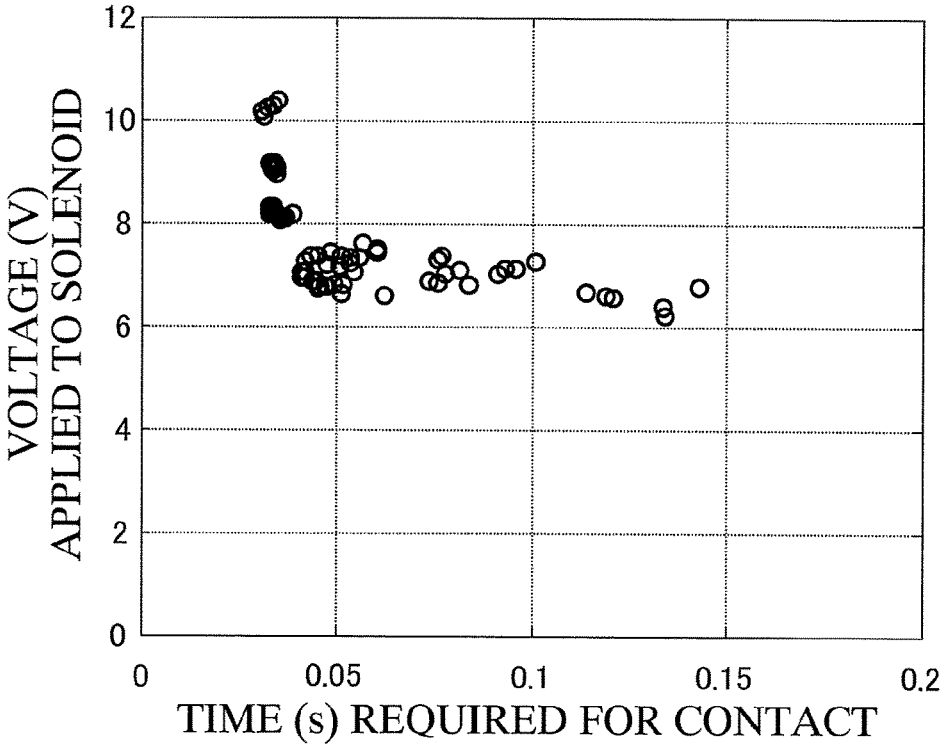
FIG. 6 Graphs created by plotting the relationship between a voltage applied to a solenoid and predetermined time (time required for contact) required for a pinion gear to come into contact with a ring gear according to the first embodiment of the present invention.
Figure 6B:
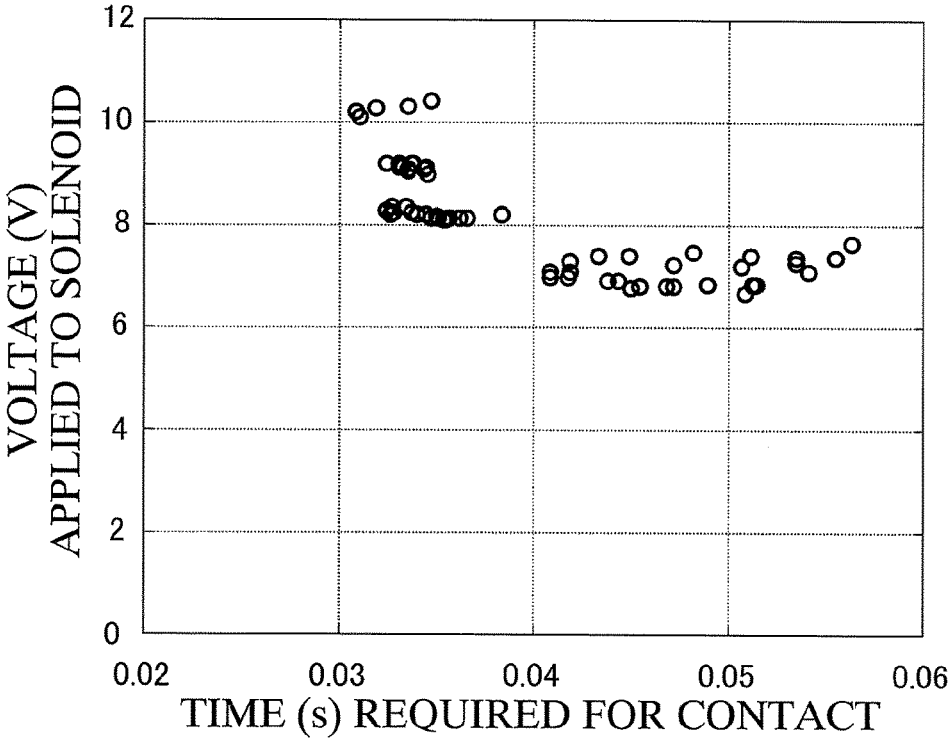

FIG. 6 are graphs created by plotting the relationship between the voltage applied to the solenoid 18 and predetermined time (time required for contact) required for the pinion gear 16 to come into contact with the ring gear 12 according to the first embodiment of the present invention. Specifically, FIG. 6 are created by plotting time required for the pinion gear 16 to move to a position at which the pinion gear 16 comes into contact with the ring gear 12 (at a position 3 mm away) while the voltage applied to the solenoid 18 is varied. FIG. 6(*b*) is a partially enlarged view of a segment from 0.02 S to 0.06 S of the time required for contact, which is indicated on a horizontal axis of FIG. 6(*a*).

As shown in FIGS. 6(*a*) and 6(*b*), it is understood that the time required for the pinion gear 16 to come into contact with the ring gear 12 abruptly increases when the voltage applied to the solenoid 18 is 9 V or smaller.

It is conceivable to increase the number of windings or reduce a winding resistance so that the solenoid 18 operates even at a low voltage in view of the above-mentioned situation. In such a case, however, the solenoid 18 is disadvantageously increased in size or a high voltage is disadvantageously applied to the solenoid 18 at the time of normal start performed without energizing the starter motor 14. As a result, the solenoid 18 generates heat to result in a reduced lifetime, or the like.

Therefore, as described in Steps S143 and S144 of the flowchart of FIG. 4 referred to above, the starter control means 11 according to the first embodiment simultaneously stops energizing the starter motor 14 and starts energizing the solenoid 18 to apply a voltage of 9 V or larger, preferably, 10 V or larger, to the solenoid 18.

As a result, as shown in FIG. 6, the predetermined time required for the pinion gear 16 to come into contact with the ring gear 12 after the start of energization of the solenoid 18 can be reduced to 40 mS or shorter, preferably, 35 mS or shorter. Therefore, the same operation characteristic as that obtained at time of normal start can be obtained.

By performing the control described above, the meshing engagement can be completed within a short time. Therefore, by restarting the energization of the starter motor 14 to restart the engine after the completion of the meshing engagement, a significant delay in restart or discomfort to the driver can be prevented from being generated.

As described above, according to the first embodiment, when the restart condition is satisfied during the inertial rotation of the engine based on the satisfaction of the automatic stop conditions, the meshing-engagement control and the engine restart are performed by the following processing series.

(1) Start energizing the starter motor;

(2) when the pinion pushing condition is satisfied, temporarily stop the energization of the starter motor and, at the same time, apply the voltage equal to or higher than the desired voltage to the solenoid to bring the pinion gear 16 into meshing engagement with the ring gear 12; and (3) restart energizing the starter motor after the completion of the meshing engagement, thereby restarting the engine by cranking.

As a result, a stable operation characteristic of the solenoid can be obtained. At the same time, smooth meshing-engagement of the gears and a quick engine restart can be realized.

The above-mentioned first embodiment has described the case where the satisfaction of the starter-motor energization condition is determined based on the elapse of the predetermined time required for the pinion gear 16 to come into meshing engagement with the ring gear 12. However, the present invention is not limited to the case described above, and the satisfaction of the starter-motor energization condition can be determined by another method. For example, the satisfaction of the starter-motor energization condition may be determined based on a change in the rotation behavior of any one of the pinion gear 16 and the ring gear 12, which is generated by a variation in the torque at the time of meshing engagement, or may be determined by using a sensor capable of actually detecting the meshing engagement, and the same effects can be obtained thereby.

Moreover, the above-mentioned first embodiment has described the case where the voltage is recovered by temporarily stopping the energization of the starter motor 14. However, the present invention is not limited to the case described above, and the voltage may be recovered by another method. For example, the current may be suppressed by PWM control or the like to recover the voltage, and the same effects can be obtained thereby. In the present invention, the temporary stop of the energization of the starter motor 14 is considered as a special case of the suppression of the current flowing through the starter motor.

The above-mentioned first embodiment has described the case where the pinion-gear moving means 17 includes the solenoid 18 and the plunger 19. However, the present invention is not limited to the case described above. The pinion gear may be moved by another configuration. For example, a small-sized motor may be used as the pinion-gear moving means 17 so as to provide a configuration in which the pinion gear 16 is pushed by the motor. The same effects can be obtained thereby.

Second Embodiment

The above-mentioned first embodiment has described the case where the energization of the solenoid 18 is started (corresponding to Step S144) simultaneously with the temporary stop of the energization of the starter motor 14 (corresponding to Step S143) in the meshing-engagement control, as illustrated in FIG. 4. On the other hand, the second embodiment describes the case where the energization of the solenoid 18 is started based on the satisfaction of a solenoid energization condition (corresponding to a pinion-gear moving condition) after the temporary stop of the energization of the starter motor 14.

Figure 7:
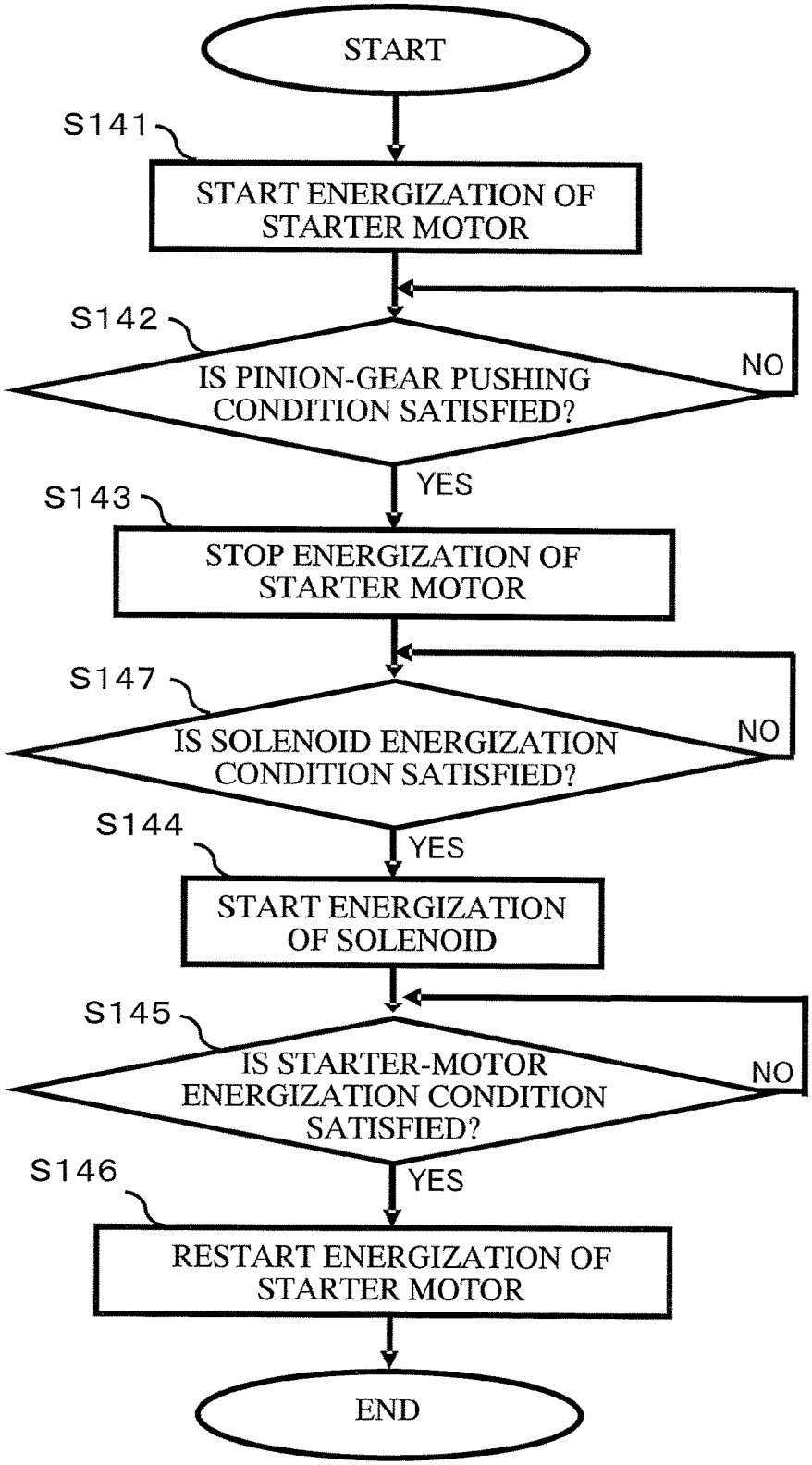
FIG. 7 A flowchart illustrating a flow of meshing-engagement control after the engine is automatically stopped according to a second embodiment of the present invention.

FIG. 7 is a flowchart illustrating a flow of meshing-engagement control after the engine is automatically stopped according to the second embodiment of the present invention. In comparison with the flowchart of FIG. 4 according to the first embodiment described above, the flowchart of FIG. 7 according to the second embodiment differs in that Step S147 is inserted between Steps S143 and S144. Therefore, processing in Step S147, which constitutes a different point, is mainly described below.

In Step S130 illustrated in FIG. 3 according to the first embodiment described above, when the starter control means 11 determines that the restart condition is satisfied during the inertial rotation of the engine, the meshing-engagement control is performed by a processing series performed in Steps S141 to S147 illustrated in FIG. 7.

The processing until the energization of the starter motor is temporarily stopped (corresponding to Steps S141 to S143) based on the satisfaction of the pinion pushing condition is the same as that of the first embodiment described above.

In the second embodiment, in Step S147 after the energization of the starter motor 14 is temporarily stopped in Step S143, the starter control means 11 determines whether or not the solenoid energization condition is satisfied. Here, the solenoid energization condition signifies elapse of predetermined time required for the power-supply voltage to recover to a level required to operate the solenoid 18 after the temporary stop of the energization of the starter motor 14. In this case, the starter control means 11 can determine the satisfaction of the solenoid energization condition based on the elapse of the predetermined time.

Immediately after the energization of the starter motor 14 is stopped, the power-supply voltage, which is lowered because of the energization of the starter motor 14, is not recovered due to the effects of inductance of a circuit or the like. The voltage is recovered with a given delay.

Therefore, in the case where the energization of the solenoid 18 is started simultaneously with the temporary stop of the energization of the starter motor 14 in the meshing-engagement control as in the first embodiment described above, the voltage to be applied does not fall within a predetermined range (corresponding to 9 V or higher shown in FIG. 6 referred to above) at the start of the energization of the solenoid 18. At least before the pinion gear 16 comes into contact with the ring gear 12, however, the voltage to be applied is required to fall within the predetermined range.

On the other hand, as in the second embodiment, by determining the timing of starting the energization of the solenoid 18, for example, based on the elapse of the predetermined time corresponding to the satisfaction of the solenoid energization condition, the voltage to be applied can be set to fall within the predetermined range even at the start of the energization.

Therefore, in the case of the second embodiment, after the elapse of the predetermined time (for example, 3 mS) in Step S147, the processing by the starter control means 11 proceeds to Step S144 where the energization of the solenoid 18 is restarted. The contents of processing in subsequent Steps S145 and S146 are the same as those described above in the first embodiment referring to FIG. 4, and therefore the description thereof is herein omitted.

As described above, according to the second embodiment, when the restart condition is satisfied during the inertial rotation of the engine based on the satisfaction of the automatic stop conditions, the meshing-engagement control and the engine restart are performed by the following processing series.

(1) Start energizing the starter motor;

(2) when the pinion pushing condition is satisfied, temporarily stop the energization of the starter motor and, after that, apply the voltage equal to or higher than the desired voltage to the solenoid at the time of the satisfaction of the solenoid energization condition to bring the pinion gear 16 into meshing engagement with the ring gear 12; and (3) restart energizing the starter motor after the completion of the meshing engagement, thereby restarting the engine by cranking.

In this manner, the recovered voltage can be applied to the solenoid so that more stable meshing-engagement between the pinion gear and the ring gear can be achieved. As a result, noise at the time of meshing engagement or component wear can be suppressed.

The above-mentioned second embodiment has described the case where the satisfaction of the solenoid energization condition is determined based on the elapse of the predetermined time. However, the present invention is not limited to the case described above, and the satisfaction of the solenoid energization condition may be determined by another method. The satisfaction of the solenoid energization condition may be determined, for example, when the power-supply voltage or the voltage applied to the solenoid becomes equal to or higher than the predetermined voltage. In this manner, the voltage which provides a reliable and stable operation characteristic in early time can be applied to the solenoid 18.

Third Embodiment

The above-mentioned first and second embodiments have described the case where the voltage is recovered by temporarily stopping the energization of the starter motor 14 (or suppressing the current by the PWM control or the like). On the other hand, a third embodiment describes the case where the voltage applied to the solenoid 18 is set to a desired value or higher by another method.

The engine automatic stop and start device 10 according to the third embodiment further includes a current suppressing circuit, a short circuit, and switching means (not shown). Here, the current suppressing circuit corresponds to an electric resistance, a coil, or the like, which is provided between the power supply and the starter motor 14.

The short circuit corresponds to a circuit for shorting the current suppressing circuit. The switching means corresponds to means for switching between ON/OFF of the short circuit to short the current suppressing circuit.

In the third embodiment, from the start of the energization of the starter motor 14 at the start of the meshing-engagement control at least to the meshing engagement between the pinion gear 16 and the ring gear 12 (hereinafter referred to as a "first time period"), the starter control means 11 switches the short circuit to an OFF state by the switching means to suppress the current by the current suppressing circuit. In this manner, the voltage applied to the solenoid 18 can be set to 8 V or higher.

On the other hand, other than the first time period, the starter control means 11 switches the short circuit to an ON state by the switching means to short the current suppressing circuit. In this manner, the inrush current generated at the start of energization of the starter motor 14 is suppressed. Further, the voltage which allows the solenoid 18 to have a stable operation characteristic can be applied.

As described above, according to the third embodiment, there is provided the configuration in that the inrush current to the starter motor can be suppressed during the predetermined time from the start of energization of the starter motor when the meshing-engagement control is started. In this manner, a reduction in the voltage to be applied to the solenoid can be suppressed. As a result, the voltage which allows the solenoid to have a stable operation characteristic can be applied.

The invention claimed is:

1. An engine automatic stop and start device for an automatic idling-stop system for automatically stopping an engine when an automatic stop condition is satisfied and restarting the engine thereafter when a restart condition is satisfied, the engine automatic stop and start device comprising:

a ring gear to be coupled to a crankshaft of the engine;

a starter motor for starting the engine;

a pinion gear for transmitting rotation of the starter motor to the ring gear;

pinion-gear moving device for moving the pinion gear by energization to bring the pinion gear into meshing engagement with the ring gear; and a starter controller that controls a voltage to be applied to the pinion-gear moving device so as to fall within a predetermined range when the pinion gear and the ring gear are brought into meshing engagement by moving the pinion gear by the pinion-gear moving device, wherein the starter controller controls the voltage to be applied to the pinion-gear moving device so that the voltage falls within the predetermined range, by suppressing a current flowing through the starter motor, at least before the pinion gear comes into contact with the ring gear during meshing-engagement control for energizing the starter motor to rotate the pinion gear and bringing the pinion gear into meshing engagement with the ring gear, by moving the pinion gear using the pinion-gear moving device when the restart condition is satisfied during inertial rotation of the engine, based on the satisfaction of the automatic stop condition.

2. The engine automatic stop and start device according to claim 1, wherein the starter controller suppresses the current flowing through the starter motor by temporarily stopping the energization of the starter motor at least before the pinion gear comes into contact with the ring gear in the meshing-engagement control.

3. The engine automatic stop and start device according to claim 2, wherein the starter controller simultaneously temporarily stops the energization of the starter motor and energizes the pinion-gear moving device to move the pinion gear in the meshing-engagement control.

4. The engine automatic stop and start device according to claim 2, wherein the starter controller energizes the pinion-gear moving device to move the pinion gear based on satisfaction of a pinion-gear moving condition after temporarily stopping the energization of the starter motor in the meshing-engagement control.

5. The engine automatic stop and start device according to claim 3, wherein the starter controller restarts the energization of the starter motor based on satisfaction of a starter-motor energization condition after the pinion gear is moved by energizing the pinion-gear moving device.

6. The engine automatic stop and start device according to claim 1, further comprising:

a current suppressing circuit provided between the starter motor and a power supply, for suppressing a current supplied from the power supply to the starter motor; and switching means connected in parallel to the current suppressing circuit, the switching means being capable of switching ON/OFF to short the current suppressing circuit, wherein the starter controller suppresses the current flowing through the starter motor by switching the switching means to an OFF state.

7. The engine automatic stop and start device according to claim 1, wherein the starter controller performs the control by setting the predetermined range so that the voltage to be applied to the pinion-gear moving device falls within a range of 9 V or higher.

8. The engine automatic stop and start device according to claim 1, wherein the starter controller performs the control by setting the predetermined range so that the voltage to be applied to the pinion-gear moving device falls within a voltage range in which time required for the pinion gear to come into contact with the ring gear is 40 mS or shorter.

9. An engine automatic stop and start control method used for an engine automatic stop and start control device for an automatic idling-stop system for automatically stopping an engine when an automatic stop condition is satisfied and restarting the engine thereafter when a restart condition is satisfied, the engine automatic stop and start control device comprising:

a ring gear to be coupled to a crankshaft of the engine;

a starter motor for starting the engine;

a pinion gear for transmitting rotation of the starter motor to the ring gear; and pinion-gear moving device for moving the pinion gear by energization to bring the pinion gear into meshing engagement with the ring gear, the engine automatic stop and start control method comprising a meshing-engagement control step of bringing the pinion gear into meshing engagement with the ring gear by energizing the starter motor to rotate the pinion gear and moving the pinion gear by the pinion-gear moving device when the restart condition is satisfied during inertial rotation of the engine based on the satisfaction of the automatic stop condition, wherein the meshing-engagement control step comprises controlling a voltage to be applied to the pinion-gear moving device so as to fall within a predetermined range by suppressing a current flowing through the starter motor at least before the pinion gear comes into contact with the ring gear.

* * * * *